US008636132B2

(12) United States Patent
Moog et al.

(10) Patent No.: US 8,636,132 B2
(45) Date of Patent: Jan. 28, 2014

(54) DEVICE AND METHOD FOR STORING BANKNOTES

(75) Inventors: Nils Moog, Borchen (DE); Thorsten Weidemann, Delbrueck (DE)

(73) Assignee: Wincor Nixdorf International GmbH (DE)

( * ) Notice: Subject to any disclaimer, the term of this patent is extended or adjusted under 35 U.S.C. 154(b) by 376 days.

(21) Appl. No.: 12/746,693

(22) PCT Filed: Nov. 20, 2008

(86) PCT No.: PCT/EP2008/065908

§ 371 (c)(1),
(2), (4) Date: Sep. 3, 2010

(87) PCT Pub. No.: WO2009/077288

PCT Pub. Date: Jun. 25, 2009

(65) Prior Publication Data

US 2011/0056415 A1 Mar. 10, 2011

(30) Foreign Application Priority Data

Dec. 18, 2007 (DE) ..... 10 2007 060 803

(51) Int. Cl.
*G07D 11/00* (2006.01)

(52) U.S. Cl.
USPC ..... 194/350; 312/211; 109/45

(58) Field of Classification Search
USPC ..... 194/350; 902/9, 11, 12, 13, 15, 17, 30; 312/211; 109/45; 235/379; 248/672, 248/128, 129, 131, 425, 429
See application file for complete search history.

(56) References Cited

U.S. PATENT DOCUMENTS

| | | | | |
|---|---|---|---|---|
| 4,325,277 | A * | 4/1982 | Uchida et al. | 83/205 |
| 4,337,864 | A | 7/1982 | McLean | |
| 4,447,097 | A * | 5/1984 | Lafevers et al. | 312/215 |
| 4,517,451 | A * | 5/1985 | Kokubo et al. | 235/379 |
| 4,595,828 | A | 6/1986 | Lundblad | |
| 4,669,393 | A * | 6/1987 | Wuthrich | 109/48 |
| 5,105,069 | A | 4/1992 | Hakenewerth et al. | |
| 5,907,141 | A * | 5/1999 | Deaville et al. | 235/375 |
| 6,170,822 | B1 * | 1/2001 | Kato et al. | 271/298 |
| 6,581,746 | B1 | 6/2003 | Lundblad | |

(Continued)

FOREIGN PATENT DOCUMENTS

| | | | |
|---|---|---|---|
| DE | 30 42 566 | A1 | 8/1981 |
| EP | 0391059 | A1 | 10/1990 |

(Continued)

OTHER PUBLICATIONS

Translation of International Preliminary Report on Patentability for PCT/EP2008/065908 (Nov. 11, 2008).

*Primary Examiner* — Mark Beauchaine
(74) *Attorney, Agent, or Firm* — Harness, Dickey & Pierce, P.L.C.

(57) ABSTRACT

The invention relates to a device and a method for storing banknotes, having at least two banknote storage containers (26 to 40). Each of the banknote storage containers (26 to 40) has at least one banknote withdrawal and/or feed opening. Further, a first receiving unit (14) for receiving at least the first banknote storage container (26 to 32) is provided. Moreover, a second receiving unit (16) for receiving at least the second banknote storage container (34 to 40) is provided. The second receiving unit (16) is arranged horizontally offset relative to the first receiving unit (14).

21 Claims, 4 Drawing Sheets

(56) References Cited

U.S. PATENT DOCUMENTS

| | | | | |
|---|---|---|---|---|
| 6,695,307 | B2 * | 2/2004 | Kanagawa | 271/207 |
| 2003/0209598 | A1 | 11/2003 | Dollhopf et al. | |
| 2005/0010525 | A1 | 1/2005 | Ross et al. | |
| 2006/0202026 | A1 * | 9/2006 | Kim | 235/381 |

FOREIGN PATENT DOCUMENTS

| | | | |
|---|---|---|---|
| EP | 1130551 | A2 | 9/2001 |
| EP | 1351200 | A2 | 10/2003 |
| EP | 1 467 326 | A1 | 10/2004 |
| WO | WO-01/54078 | A2 | 7/2001 |

* cited by examiner

DEVICE AND METHOD FOR STORING BANKNOTES

CROSS-REFERENCE TO RELATED APPLICATIONS

This application is a National Stage of International Application No. PCT/EP2008/065908, filed Nov. 20, 2008. This application claims the benefit and priority of German application 10 2007 060 803.0 filed Dec. 18, 2007. The entire disclosure of the above application is incorporated herein by reference.

BACKGROUND

This section provides background information related to the present disclosure which is not necessarily prior art.

TECHNICAL FIELD

The invention relates to a device and a method for storing banknotes, in which at least two banknote storage containers are provided, each of which has at least one banknote withdrawal and/or banknote feed opening. Further, the invention relates to an automated teller machine for the deposit and withdrawal of banknotes.

DISCUSSION

A large number of known automated teller machines have banknote storage containers for storing banknotes, in which storage containers the banknotes are stored either as banknote stacks with banknotes being arranged one after the other or in winding storages. Banknote storage containers of this type are in particular known from documents WO 01/54078 A2 and DE 3042566 C. Usually, these banknote storage containers are used to store banknotes of a denomination of the same currency so that the number of different banknotes which can be stored in an automated teller machine, in particular of banknotes of different denominations is limited.

Due to the limited storage capacity of a banknote storage container, also the storage of the total amount of banknotes which can be stored in the automated teller machine is limited so that in particular in the case of automated teller machines with relatively high daily withdrawal amounts a daily replenishment is necessary in order to reliably provide the required withdrawal amounts. The banknote storage containers can be inserted into known automated teller machines and again be removed therefrom. The banknote storage containers are also used for the transport of banknotes from and to the automated teller machine. Banknote storages are generally also referred to as banknote cassettes.

Known automated teller machines offer the possibility of receiving four, maximum five banknote storage containers stacked on top of one another. By arranging the banknote storage containers under the control panel of the automated teller machine, by which a man-machine interface for a user of the automated teller machine is provided, the number of banknote storage containers cannot be increased further in an arbitrary manner. Similar problems exist with known automatic cash safes which output a requested amount to a bank clerk as well as with automatic cash systems in the retail trade.

SUMMARY OF THE INVENTION

It is the object of the invention to specify a device and a method for storing banknotes, by which the storage capacity of banknotes which can be stored is increased in an easy manner.

This object is solved by a device for storing banknotes having the features of claim 1. Further, the object is solved by a method specified in the claims and an automated teller machine specified in the claims. Advantageous developments of the invention are specified in the dependent claims.

What is achieved by a device having the features of claim 1 is that at least a first banknote storage container is received by a first receiving unit and at least a second banknote storage container is received by at least a second receiving unit. The receiving units are arranged horizontally offset so that only a relatively small space is required for arranging the two receiving units. In particular, both receiving units can be arranged one after the other in a safety area, such as a safe, the safety area being provided with a closable opening through which the receiving units together with the banknote storage containers arranged in the receiving units can be pushed in or pulled out.

In one development, the receiving units are arranged such that the banknote storage containers received by them are oriented identically so that the banknote withdrawal and/or banknote feed openings of the banknote storage containers face in the same direction in an operating position. As a result thereof, the banknote storage containers can be relatively easily removed from the receiving units when these were moved from the operating position into a service position. In particular, the banknote storage containers can be removed from the receiving units after at least one of the receiving units was moved out of a safety area in which the receiving units are arranged in the operating position.

In another development of the invention, the banknote storage containers have, on the side opposite to the banknote withdrawal and/or banknote feed opening, a recess and/or a handle by which the pulling of the respective banknote storage container out of a receiving unit is facilitated. Further, each banknote storage container and/or each receiving unit can have at least one locking element by means of which each of the banknote storage containers can be locked in the respective receiving unit. Preferably, this locking element can be integrated in the handle and/or recess or can be engaged therewith such that upon turning the handle and/or upon actuating an actuation element an unlocking of the banknote storage container takes place.

To each receiving unit preferably at least one transport element for the removal of banknotes from at least one banknote storage container, for the feed of banknotes into a banknote storage container, for the transport of banknotes to a banknote storage container and/or for the transport of banknotes removed from a banknote storage container is assigned. The transport elements are at least in part fixed to the receiving unit and each of them forms at least one transport path of the receiving unit.

Preferably, the device has a transfer point via which banknotes for the storage in one of the banknote storage containers are fed to the device and/or via which the banknotes removed from one of the banknote storage containers are output from the device. The transfer interface can have a sorting gate. In addition or alternatively, the device can have a sorting gate which is arranged downstream of the transfer point in deposit direction. With the aid of at least one of these sorting gates, fed-in banknotes to be stored in one of the banknote storage containers can be supplied optionally to a first transport path assigned to the first receiving unit or to a second transport path assigned to the second transport unit depending on the position of the sorting gate. Alternatively or in addition, with the aid of the sorting gate the banknotes removed from the banknote storage containers and transported via the transport elements to the transfer interface can be output by the device via the transfer interface.

If the receiving units with the banknote storage containers are arranged in an operating position in a closed safety area which can be accessed from the outside via at least one closable access opening, it is advantageous if at least the first receiving unit with the at least one banknote storage container can be pulled out from the opening of the safety area into a service position. As a result thereof, an easy access to the banknote storage containers arranged in the first receiving unit and in the second receiving unit is made possible.

It is particularly advantageous if the first receiving unit and at least the second receiving unit can be pulled out of the safety area. At least one of the receiving units can be swiveled or rotated in the pulled-out state so that as a result thereof a removal of the banknote storage containers from the second receiving unit is likewise easily possible. The distance provided between the receiving units in the operating position is preferably automatically increased during pulling out. Alternatively or in addition, the distance provided between the receiving units in the operating position can be increased after pulling out. Increasing the distance during pulling out or after pulling out can take place in particular with the aid of a lever system and/or a slotted-link control. In addition or alternatively, at least one of the receiving units can be automatically rotated about a rotation axis during pulling out. Alternatively or in addition, at least one receiving unit is rotatable about a rotation axis after pulling out. The rotation axis is preferably arranged such that during rotation substantially only a perpendicular force in the direction of the rotation axis and no or only a small lateral force orthogonal to the rotation axis is exerted.

The device can have pull-out rails with the aid of which the first receiving unit and/or the second receiving unit can be pulled out from the opening of the safety area. As a result thereof, an easy access to the receiving units and the banknote storage containers arranged therein is possible so that in particular an easy replacement of the banknote storage containers is possible.

In an advantageous embodiment, each of the receiving units has the possibility of receiving at least two, preferably at least four or five banknote storage containers each, wherein the banknote storage containers are stacked on top of one another in each of the receiving units and are preferably identically oriented.

When arranging four banknote storage containers each in each of the receiving units thus altogether eight banknote storage containers can be provided. Instead of a banknote storage container also a cassette having a printing device for printing additional receipts or vouchers, in particular admission tickets, can be provided, which can then be output in the same manner as banknotes via an output bin of an automated teller machine. Alternatively or additionally, these printouts can also be output from an automatic cash system or a self-service cash system in the retail trade.

The banknote storage containers can comprise a winding storage or a stack storage which are both suited for storing banknotes.

It is advantageous if the device comprises a slotted-link control or a lever system, which is engaged with a pull-out system for pulling out the receiving units from the opening of the safety area such that the distance between the first receiving unit and the second receiving unit is increased during pulling out and/or that the second receiving unit which is arranged behind the first receiving unit is moreover swiveled or rotated into a service position. Alternatively or additionally, the slotted-link control and/or the lever system can be engaged with a further element that moves relative to the receiving units when the receiving unit is pulled out such that the distance between the first receiving unit and the second receiving unit is increased during pulling out and/or that the second receiving unit arranged behind the first receiving unit is swiveled from the operating position into a service position. As a result thereof, a comfortable arrangement of the receiving units in a service position is made possible merely by pulling out the receiving units, wherein in the service position an easy replacement of the banknote storage containers is possible without installation work or other operating actions being necessary for it.

It is pointed out that the claimed method, too, can be developed with features which have been disclosed above or are disclosed in the following description in connection with the inventive device. In particular, the claimed method can be developed with the features included in the dependent claims or with respective method features.

BRIEF DESCRIPTION OF THE DRAWINGS

Further features and advantages of the invention result from the following description which in connection with the enclosed Figures explains the invention in more detail with reference to an embodiment.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
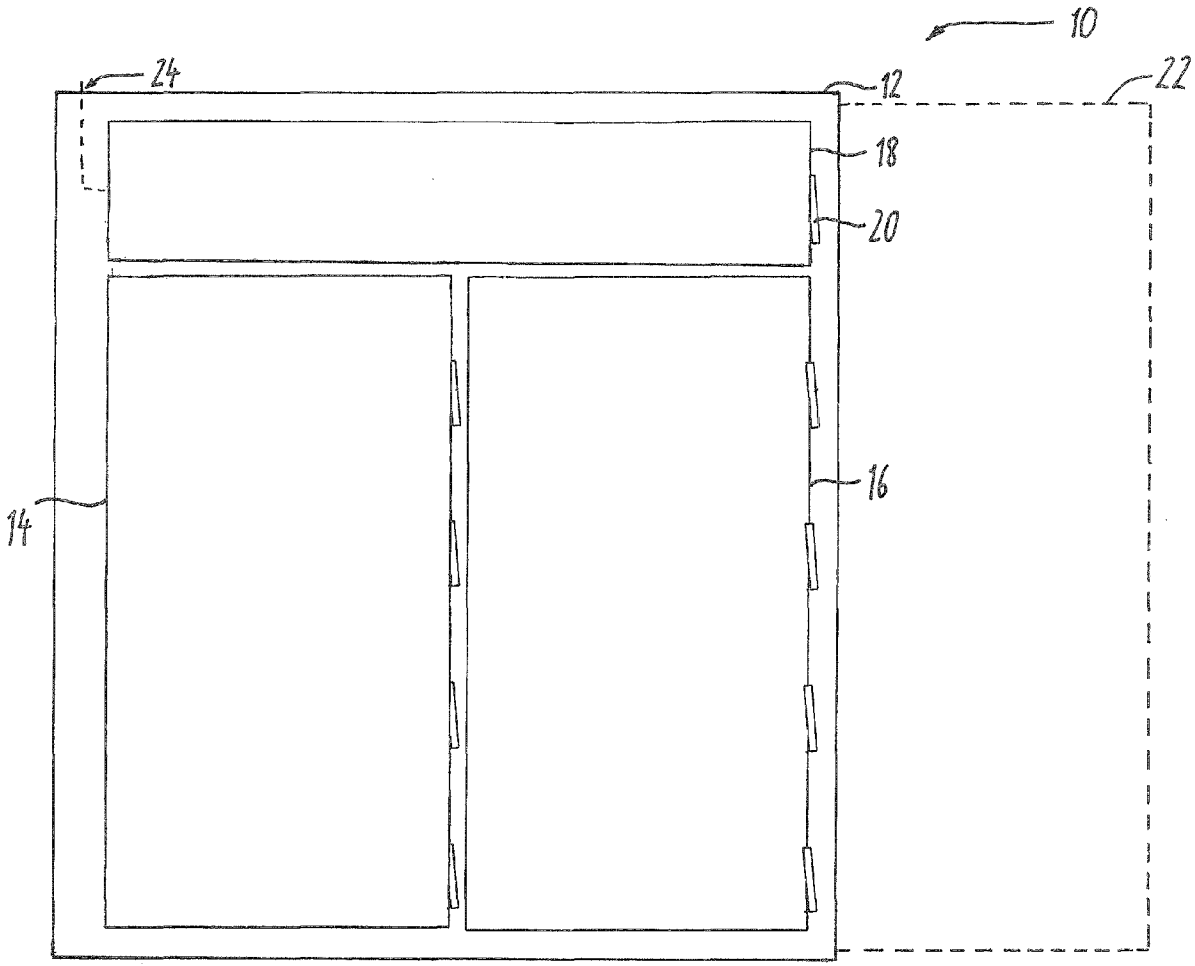
FIG. 1 shows a side view of a device for storing banknotes in which a safe is illustrated in cross-section.

In FIG. 1, a device 10 for storing banknotes is illustrated, which has two receiving units 14, 16, arranged in a safe 12, for receiving banknote cassettes. Into each of the receiving units 14, 16 four banknote storage cassettes are inserted, of which in FIG. 1 only a part of the handle being visible each time. Further, the device 10 comprises a banknote handling unit 18 to which the banknotes removed from the banknote cassettes of the receiving units 14, 16 are fed and which feeds the banknotes to be stored in the banknote cassettes to the receiving units 14, 16. Further, the banknote handling unit 18 has another banknote storage cassette, a so-called reject cassette, the handle of which has the reference sign 20. Into this reject cassette banknotes are fed which are not to be fed to the banknote cassettes arranged in the receiving units, in particular banknotes that have not been taken out of an output bin. In other embodiments of the invention, the reject cassette is arranged in one of the receiving units instead of one of the banknote cassettes arranged therein, wherein the reject cassette preferably only distinguishes itself from the other banknote storage cassettes in its specific function.

The receiving units 14, 16 and the handling unit 18 can be pulled out from the opening of the safe 12 which is closable by a safe door 22 so that an easy access to all banknote cassettes present in the receiving units 14, 16 or to the cassette receptacles provided by the receiving units 14, 16 is made possible. The open state of the safe door 22 is illustrated in FIG. 1 with a broken line. For the output of banknotes by the device 10 and for the feed of banknotes to the device 10 a transfer point 24 is provided via which banknotes can be output in particular for the further transport to an output bin of an automated teller machine or an automatic cash safe. The safe 12 is illustrated in FIG. 1 without a side wall so that in the side view of the device 10 illustrated in FIG. 1 the receiving units 14, 16 arranged in an operating position within the safe 12 as well as the handling unit 18 are visible. The transport path of the banknotes from the transfer point 24 to the handling unit 18 and vice versa is indicated by a broken line and is provided by means of suitable transport elements.

Figure 2:
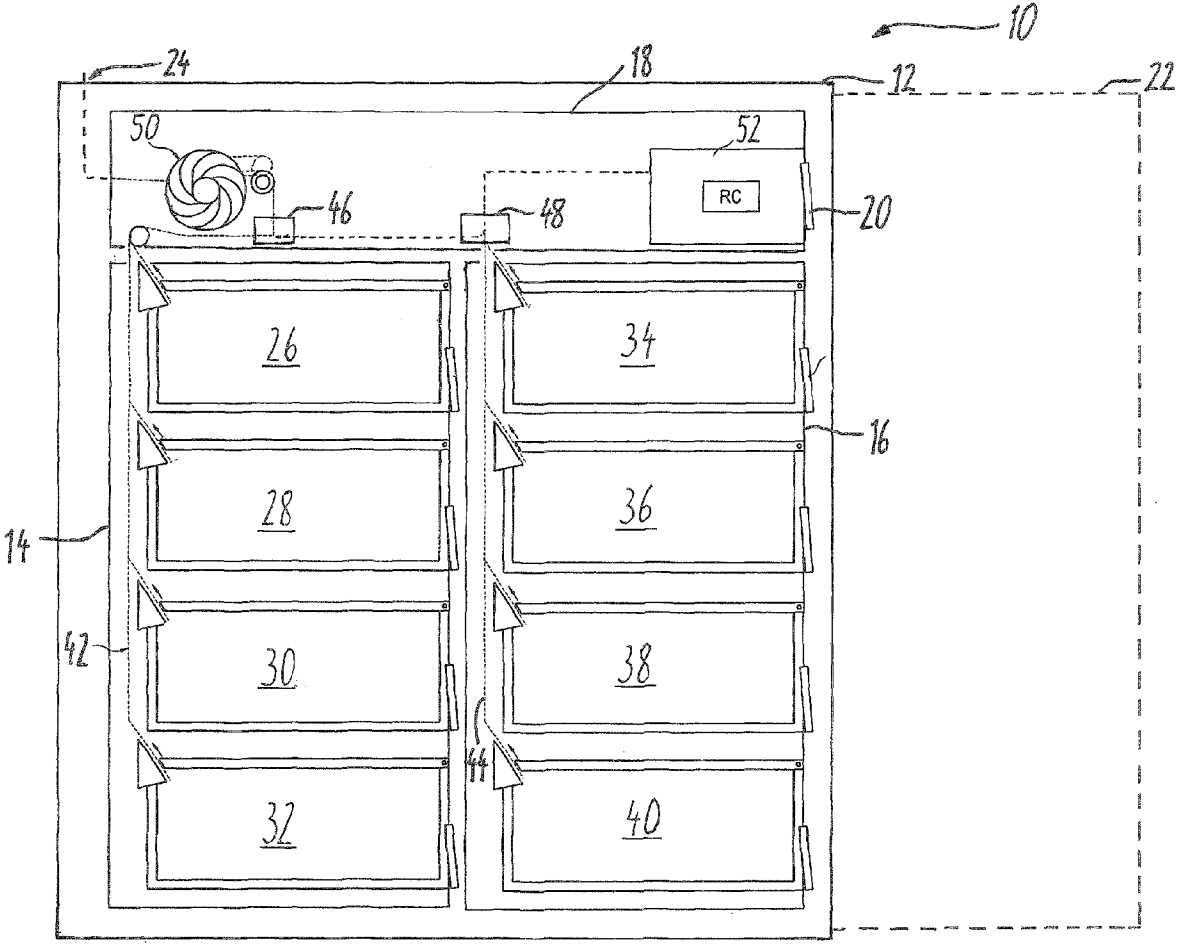
FIG. 2 shows the device according to FIG. 1, wherein the receiving units for receiving banknotes to be stored as well as a part of the transport elements for the transport of banknotes are illustrated in cross-section.

In FIG. 2, the device 10 according to FIG. 1 is illustrated, wherein the receiving units 14, 16 as well as the banknote cassettes 26 to 40 present therein are illustrated in cross-section. Each of the receiving units 14, 16 further comprises transport elements for the transport of banknotes to the cassettes 26 to 40 as well as sorting gates and actuating means for the removal of individual banknotes from a cassette 26 to 40 as well as for the feed of individual banknotes into a cassette 26 to 40. The sorting gates for feeding individual banknotes to a cassette 26 to 40 as well as from a cassette 26 to 40 to a transport path 42, 44 formed by the transport elements mentioned are schematically illustrated in FIG. 2 as triangles. The handling unit 18 includes several sorting gates, of which the sorting gates 46, 48 are illustrated and which allow for the transport of banknotes for a desired action. In addition to the reject cassette 52 already mentioned in connection with FIG. 1, the handling unit 18 includes a stacking wheel 50 which stacks the banknotes individually removed from the cassettes 26 to 40, the banknote stack created being output from the device 10 via the transfer interface 24. In other embodiments of the invention, individual elements such as the stacking wheel 50 and the reject cassette 52 can also be arranged outside of the safe 12. Preferably, however, transport elements which make a substantially horizontal transport of banknotes between the receiving units 14, 16 possible are provided in the safe 12. These transport elements are preferably not components parts of the receiving units 14, 16 but are contained in a separate transport or handling unit 18. As a result thereof, it is possible that the device 10 has only one transfer point 24 to further elements of an automated teller machine. As a result thereof, known devices can easily be replaced by the device 10. Such known devices only have several banknote cassettes arranged on top of each other and no banknote cassette stacks arranged one after the other, such as the device 10 according to FIGS. 1 and 2. The feed and withdrawal openings of the banknote cassettes 26 to 40 are arranged opposite to the handles and are engaged with suitable transport elements and withdrawal and feed elements, respectively, when the banknote cassettes 26 to 40 are inserted into the receiving units 14, 16. When they are inserted and arranged in the receiving units 14, 16 in the operating position shown in FIGS. 1 and 2, the banknote cassettes 26 to 40 are oriented such that the feed and withdrawal openings of all banknote cassettes 26 to 40 of the banknote cassettes 26 to 40 present in the receiving units 14, 16 face in the same direction. It is particularly advantageous when, in the operating position illustrated in FIGS. 1 and 2, the handles lying opposite to the feed and withdrawal openings face in the direction of the opening of the safe 12 closable by the safe door 22. As a result thereof, when the safe door 22 is open, an easy removal of the banknote cassettes 34 to 40 from the second receiving unit 16 as well as after pulling out the receiving unit 16 and/or after pulling out the receiving unit 14 also an easy handling of the cassettes 26 to 32 as well as their replacement is made possible.

Figure 3:
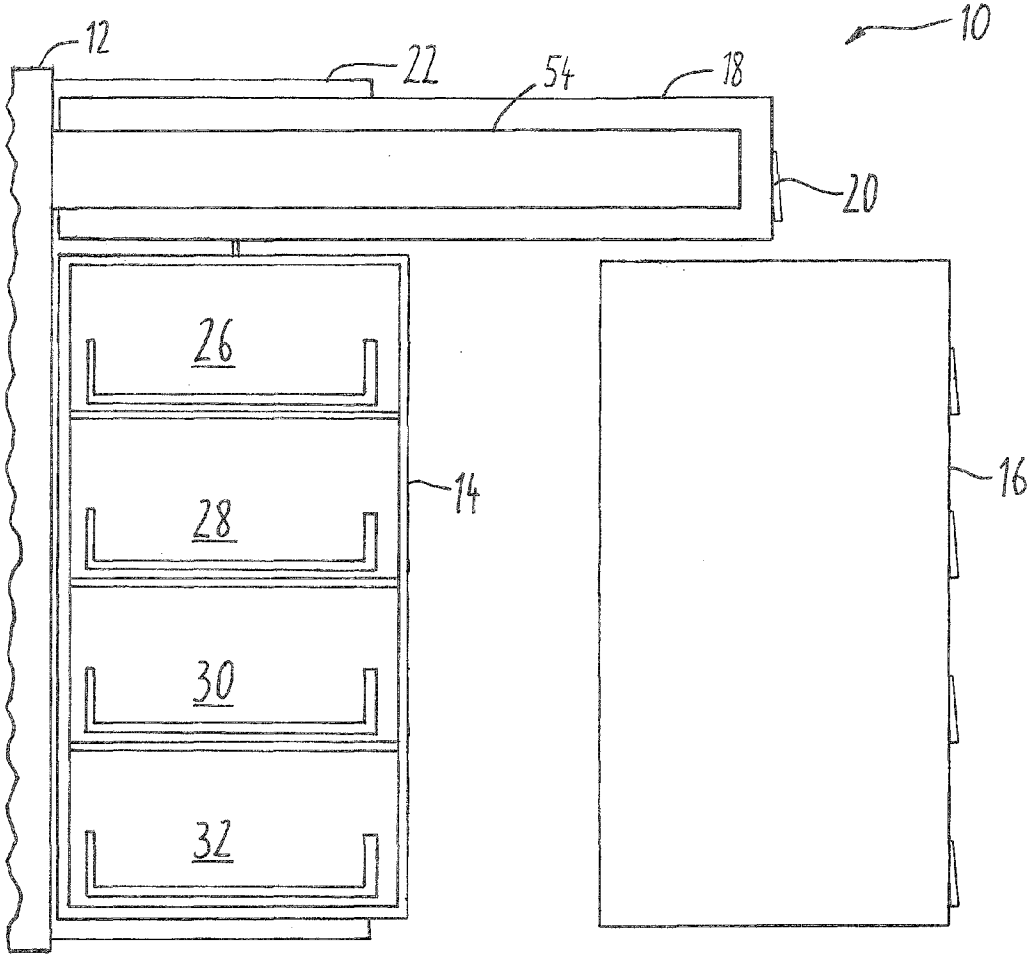
FIG. 3 shows a side view of receiving units of the device according to FIGS. 1 and 2, wherein the receiving units are illustrated as being pulled out of the safe.

In FIG. 3, the receiving units 14, 16 as well as the handling unit 18 are illustrated in a state where they are pulled out of the safe 12 with the safe door 22 being open.

To the side of the banknote handling unit 18, one pull-out rail each for pulling out the banknote handling unit 18 and the receiving units 14, 16 is provided, of which the pull-out rail 54 is visible in FIG. 3. During pulling out of the receiving units 14, 16 from the safe 12 the distance between the receiving units 14, 16 has been increased. After the distance between the receiving units 14, 16 has been sufficiently increased, the receiving unit 14 is rotated so that a lateral replacement of the banknote cassettes 26 to 32 is possible. The rotation or swivel axis for rotating or swiveling the receiving unit 14 preferably runs perpendicular through the center of gravity of the receiving unit 14 so that only little or no lateral load is caused during rotation of the receiving unit 14 and the pull-out rails 54 are not or only slightly loaded by the rotation.

Figure 4:
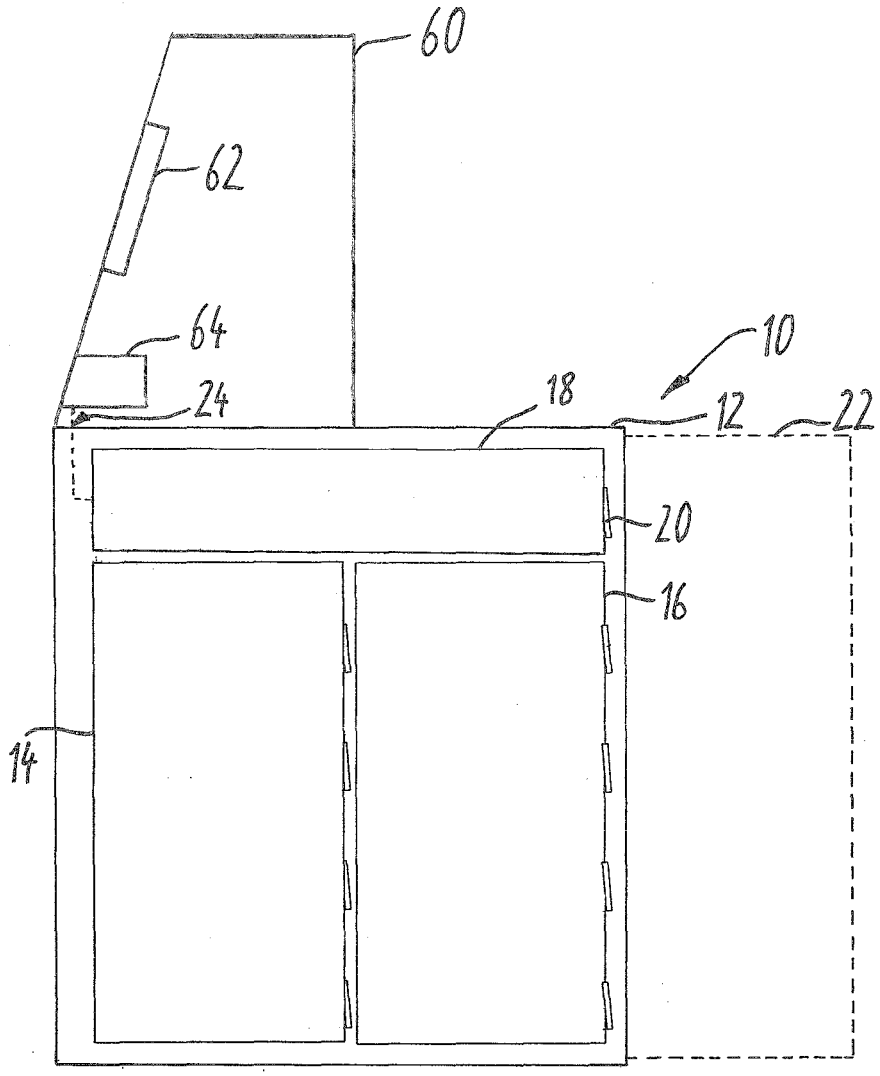
FIG. 4 shows a cross-sectional illustration of an automated teller machine having a device for storing banknotes according to FIGS. 1 to 3.

In FIG. 4, a combination of the device 10 and an operating terminal 60 to form an automated teller machine is shown, wherein the operating terminal 60 has a display and operating unit 62, preferably with a display unit, preferably a touch screen, freely programmable input keys, a numeric keypad, a card reader, possibly with devices for detecting biometric information of an operator as well as a cash output bin 64. Further, both the operating terminal 60 and the device 10 have non-illustrated control units for controlling the deposit and withdrawal operations of banknotes as well as authentication operations and authorization operations. As already mentioned, in the present embodiment a banknote stack is provided by the handling unit 18 and output to the output bin 64 via the transfer point 24. In other embodiments, the banknotes are individually transferred between the operating terminal 60 and the safe 12, wherein the stacking and separating then takes place in the operating terminal 60, for example with a stacking wheel 50. Further, the reject cassette can also be arranged in the operating terminal. In a front view of the automated teller machine, the receiving units 14, 16 are arranged one after the other so that only a relatively small overall width for the safe 12 of the device 10 as well as for the automated teller machine illustrated in FIG. 4 is required. In other embodiments, also more than two receiving units 14, 16 can be arranged one after the other, each of which can receive at least one, preferably several banknote cassettes.

In the embodiment, an automated teller machine for cash deposit and cash withdrawal is shown and described. Automated teller machines of this type are also referred to as recyclers if deposited banknotes are again used for pay-out. The invention can however also be used in the same manner with mere cash withdrawal machines and mere cash deposit machines, as well as automatic cash safes and automatic cash systems in the retail trade.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for storing banknotes, comprising:

at least two banknote storage containers, each of which includes at least one banknote withdrawal and/or banknote feed opening;

a first receiving unit for receiving at least the first banknote storage container; and at least a second receiving unit for receiving at least the second banknote storage container;

wherein the second receiving unit is arranged horizontally offset with respect to the first receiving unit;

wherein the banknote withdrawal and/or banknote feed openings of the banknote storage containers of the first receiving unit are each adjacent to a common first vertical transport path;

wherein the banknote withdrawal and/or banknote feed openings of the banknote storage containers of the second receiving unit are each adjacent to a common second vertical transport path that is offset from the first vertical transport path;

wherein the device comprises a closed safety area that can be accessed from the outside via a closable opening, in which safety area the receiving units and the banknote storage containers are arranged in an operating position, and in that at least the first receiving unit with the at least one banknote storage container can be pulled out from the opening of the safety area;

wherein both receiving units can be pulled out of the safety area, wherein at least one of the receiving units can be rotated from the operating position into a service position in the pulled-out state; and wherein the distance provided between the receiving units in the operating position is automatically increased during pulling out and/or that the distance provided between the receiving units in the operating position can be increased after pulling out.

2. The device according to claim 1, wherein the receiving units are arranged such that the banknote storage containers received by them are identically oriented so that the banknote withdrawal and/or banknote feed openings of the banknote storage containers face in the same direction in an operating position.

3. The device according to claim 1, wherein the banknote storage containers have, on the side lying opposite to the banknote withdrawal and/or banknote feed opening, a recess and/or a handle by means of which the pulling of the respective banknote storage container out of a receiving unit is facilitated.

4. The device according to claim 1, wherein each banknote storage container and/or each receiving unit has at least one locking element by means of which each of the banknote storage containers can be locked in the respective receiving unit.

5. The device according to claim 1, wherein to each receiving unit at least one transport element for the removal of banknotes from at least one banknote storage container, for the feed of banknotes into a banknote storage container, for the transport of banknotes to a banknote storage container and/or for the transport of banknotes removed from a banknote storage container is assigned.

6. The device according to claim 1, wherein the device has a transfer point via which banknotes for the storage in one of the banknote storage containers are fed to the device and/or via which banknotes removed from one of the banknote storage containers are output from the device.

7. The device according to claim 1, wherein the device has pull-out rails with the aid of which the first receiving unit and/or the second receiving unit can be pulled out from the opening of the safety area.

8. The device according to claim 1, wherein at least one rotation axis is provided about which at least one of the receiving units can be rotated, wherein the rotation axis is arranged such that during the rotation operation substantially only a perpendicular force in the direction of the rotation axis is exerted.

9. The device according to claim 1, wherein each of the receiving units provides a possibility of receiving at least two banknote storage containers, wherein the banknote storage containers are exclusively arranged on top of one another in each of the receiving units.

10. The device according to claim 1, wherein the banknote storage containers arranged in the receiving units can be replaced.

11. The device according to claim 1, further comprising a horizontal transport path connecting the first vertical transport path of the first receiving unit to the second vertical transport path of the second receiving unit.

12. The device according to claim 1, wherein transport elements of the first vertical transport path adjacent to one receiving unit are fixed to the respective receiving unit.

13. The device according to claim 12, further comprising a sorting gate at a transfer point or downstream of the transfer point in a deposit direction, wherein, with the aid of the sorting gate, fed-in banknotes to be stored in the banknote storage containers are supplied to the first vertical transport path or the second vertical transport path depending on the position of the sorting gate and/or wherein, with the aid of the sorting gate, the banknotes removed from the banknote storage containers and transported by the transport elements to the transfer point are output by the device via the transfer point.

14. The device according to claim 1, wherein the banknote storage containers each have at least one winding storage or a stack storage for storing banknotes.

15. The device according to claim 1, wherein the device comprises a slotted-link control and/or a lever system which is engaged with a pull-out system for pulling out the receiving units from an opening of a safety area and/or with a further element moving relative to the receiving units when these are pulled out such that the distance between the first receiving unit and the second receiving unit is increased during pulling out and/or that the second receiving unit arranged horizontally offset relative to the first receiving unit is swiveled from the operating position into a service position.

16. An automated teller machine for the deposit and/or withdrawal of banknotes, having a device according to claim 1.

17. A method for storing banknotes comprising:

feeding banknotes into and/or removing banknotes from at least two banknotes storage containers of a device for storing banknotes, each of which has at least one banknote withdrawal and/or banknote feed opening, at least the first banknote storage container is received by a first receiving unit, at least the second banknote storage container is received by at least a second receiving unit;

wherein the second receiving unit is arranged horizontally offset relative to the first receiving unit;

wherein the banknote withdrawal and/or banknote feed openings of the banknote storage containers of the first receiving unit are each adjacent to a common first vertical transport path;

wherein the banknote withdrawal and/or banknote feed openings of the banknote storage containers of the second receiving unit are each adjacent to a common second vertical transport path that is offset from the first vertical transport path;

wherein the device comprises a closed safety area that can be accessed from the outside via a closable opening, in which safety area the receiving units and the banknote storage containers are arranged in an operating position, and in that at least the first receiving unit with the at least first banknote storage container can be pulled out from the opening of the safety area;

wherein both receiving units can be pulled out of the safety area, wherein at least one of the receiving units can be rotated from the operating position into a service position in the pulled-out state; and wherein the distance provided between the receiving units in the operating position is automatically increased during pulling out and/or that the distance provided between the receiving units in the operating position can be increased after pulling out.

18. A device for storing banknotes, comprising:

at least two banknote storage containers, each of which includes at least one banknote withdrawal and/or banknote feed opening;

a first receiving unit for receiving at least the first banknote storage container; and at least a second receiving unit for receiving at least the second banknote storage container;

wherein the second receiving unit is arranged horizontally offset with respect to the first receiving unit;

wherein the banknote withdrawal and/or banknote feed openings of the banknote storage containers of the first receiving unit are each adjacent to a common first vertical transport path;

wherein the banknote withdrawal and/or banknote feed openings of the banknote storage containers of the second receiving unit are each adjacent to a common second vertical transport path that is offset from the first vertical transport path;

wherein each of the receiving units is configured to receive at least two banknote storage containers, the banknote storage containers are exclusively arranged on top of one another in each of the receiving units; and wherein the vertical transport paths to which each of the receiving units are adjacent are arranged vertically, and a horizontal transport path connects the first vertical transport path of the first receiving unit to the second vertical transport path of the second receiving unit.

19. The device of claim 18, wherein the device comprises a closed safety area that can be accessed from the outside via a closable opening, in which safety area the receiving units and the banknote storage containers are arranged in an operating position, and in that at least the first receiving unit with the at least one banknote storage container can be pulled out from the opening of the safety area; and wherein both receiving units can be pulled out of the safety area, wherein at least one of the receiving units can be rotated from the operating position into a service position in the pulled-out state.

20. A method for storing banknotes comprising:

feeding banknotes into and/or removing banknotes from at least two banknotes storage containers of a device for storing banknotes, each of which has at least one banknote withdrawal and/or banknote feed opening, at least the first banknote storage container is received by a first receiving unit, and at least the second banknote storage container is received by at least a second receiving unit;

wherein the second receiving unit is arranged horizontally offset relative to the first receiving unit;

wherein the banknote withdrawal and/or banknote feed openings of the banknote storage containers of the first receiving unit are each adjacent to a common first vertical transport path;

wherein the banknote withdrawal and/or banknote feed openings of the banknote storage containers of the second receiving unit are each adjacent to a common second vertical transport path that is offset from the first vertical transport path;

wherein each of the receiving units is configured to receive at least two banknote storage containers, the banknote storage containers are exclusively arranged on top of one another in each of the receiving units; and wherein the vertical transport paths to which each of the receiving units are adjacent are arranged vertically, and a horizontal transport path connects the first vertical transport path of the first receiving unit to the second vertical transport path of the second receiving unit.

21. The method of claim 20, wherein the device comprises a closed safety area that can be accessed from the outside via a closable opening, in which safety area the receiving units and the banknote storage containers are arranged in an operating position, and in that at least the first receiving unit with the at least first banknote storage container can be pulled out from the opening of the safety area; and wherein both receiving units can be pulled out of the safety area, wherein at least one of the receiving units can be rotated from the operating position into a service position in the pulled-out state.

* * * * *